United States Patent [19]

Roggenburg, Jr.

[11] Patent Number: 4,921,136

[45] Date of Patent: May 1, 1990

[54] FIXTURE FOR BAG-TYPE LIQUID DISPENSER

[75] Inventor: Stanley L. Roggenburg, Jr., Staten Island, N.Y.

[73] Assignee: Inopak Ltd., Mahwah, N.J.

[21] Appl. No.: 277,229

[22] Filed: Nov. 29, 1988

[51] Int. Cl.[5] ..... B65D 35/28

[52] U.S. Cl. ..... 222/95; 222/105; 222/181; 222/183; 222/214; 222/494

[58] Field of Search ..... 222/181, 183, 185, 95, 222/105, 214, 494; 248/221.4

[56] References Cited

U.S. PATENT DOCUMENTS

| | | | |
|---|---|---|---|
| 2,873,884 | 2/1959 | Goldfarb | 222/214 X |
| 3,934,761 | 1/1976 | Gentrean | 222/183 |
| 4,142,651 | 3/1979 | Lepoldi et al. | 222/185 |
| 4,463,876 | 8/1984 | Swallert | 222/214 X |
| 4,634,022 | 1/1987 | O'Halloran et al. | 222/214 X |
| 4,645,154 | 2/1987 | Bly | 248/221.4 X |
| 4,823,990 | 4/1989 | Roggenburg et al. | 222/341 X |

*Primary Examiner*—Michael S. Huppert
*Assistant Examiner*—Gregory L. Huson
*Attorney, Agent, or Firm*—Kenyon & Kenyon

[57] ABSTRACT

A fixture for a bag-type liquid dispenser has a bracket having an upstanding plate for attachment to a wall and from the bottom of which a shelf having a nozzle hole extends forwardly, and a cover adapted to open and close in front of the plate and shelf. The dispenser has a flexible bag in which the liquid is sealed and having a main portion in front of the plate and a dispensing portion folded forwardly on the shelf and having a dispensing nozzle extending downwardly through the nozzle hole. The cover has a forwardly extending portion covering the bag's forwardly folded dispensing portion, an opening being formed in this forwardly extending portion above the actuator, and a push button being positioned in this opening for applying pressure on the valve's actuator.

6 Claims, 5 Drawing Sheets

17
B
7
3a
8
10
C
1
3
3b
13
12
12
5
2
4
3

17
B
7
3a
8
C
10
3
3b
12
13
12
2
4
3

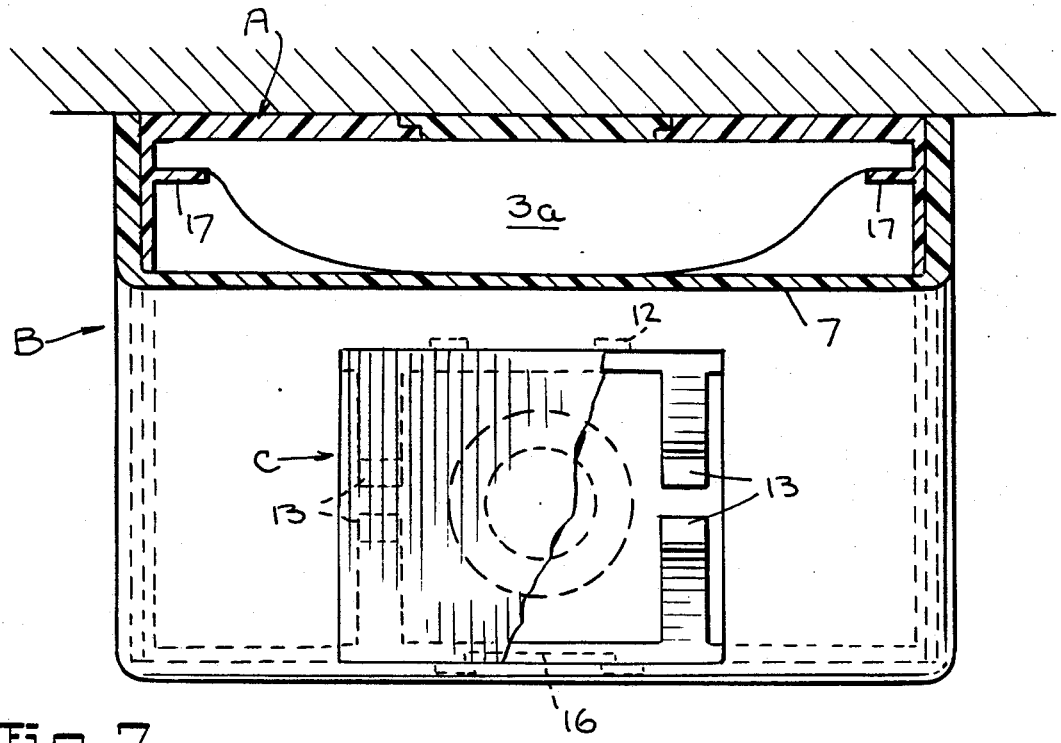
Fig. 7.
Fig. 8.
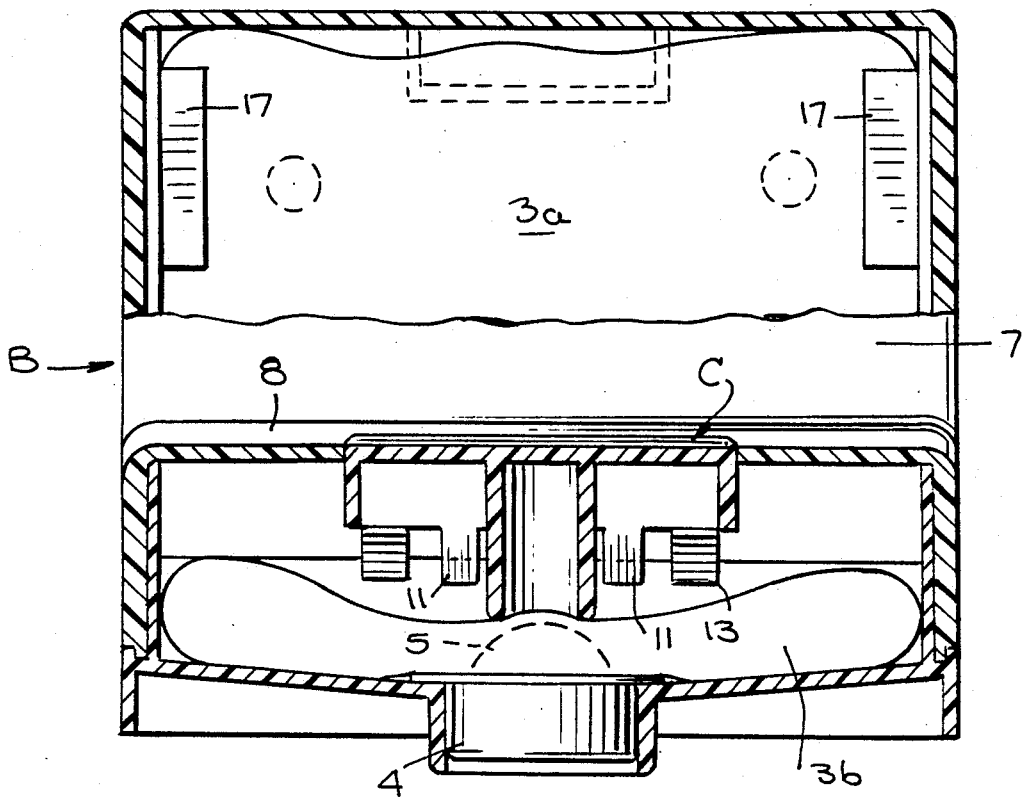

FIXTURE FOR BAG-TYPE LIQUID DISPENSER

This invention is an improved fixture for a bag-type liquid dispenser of the type disclosed by U.S. Pat. No. 4,634,022.

This type comprises a bracket having an upstanding plate for attachment to a wall and from the bottom of the plate a shelf having a nozzle hole extends forwardly. A cover is adapted to open and close in front of the plate and shelf. The dispenser comprises a flexible bag in which the liquid is sealed and having a main portion positioned in front of the plate and a dispensing portion folded forwardly on the shelf and having a dispensing valve with a nozzle extending downwardly through the nozzle hole. The cover has a forwardly extending portion covering the bag's forwardly folded dispensing portion. A push button opening is formed in this forwardly extending cover portion above the actuator, and a push button is positioned in this opening for applying downward pressure on the valve's actuator.

The object of the present invention is to reduce the costs of making and assembling the parts required for the production of a fixture of this type, to reduce the number of parts required, and to design the parts so that, if desired, each can be made as a single integral plastic injection molding.

Briefly summarized, in the present case the push-button opening in the cover's forwardly extending portion has a guideway extending downwardly from the opening and in which the push button moves up and down on the dispensing valve's operator. The cover has springs biasing the push-button upwardly. All of these parts may be a single integral plastic injection molding. The push-button has depending fingers with bottom hooks which engage the bottom of the guideway and hold the push-button against the bias of the springs. Each of these parts may be integrally formed as a single plastic injection molding. The cover also may be a single integral plastic injection molding. The edges of the bracket and cover are made as tongue and groove elements so that the cover can be slid onto and from the bracket without requiring any other elements for releasably connecting the cover with the bracket.

A specific example of the new fixture is disclosed below with the aide of the accompanying drawings in which:

FIG. 7 is a partially transparent top cross-section of the present invention; and FIG. 8 is a partially transparent front cross-section of the present invention.

Figure 1:
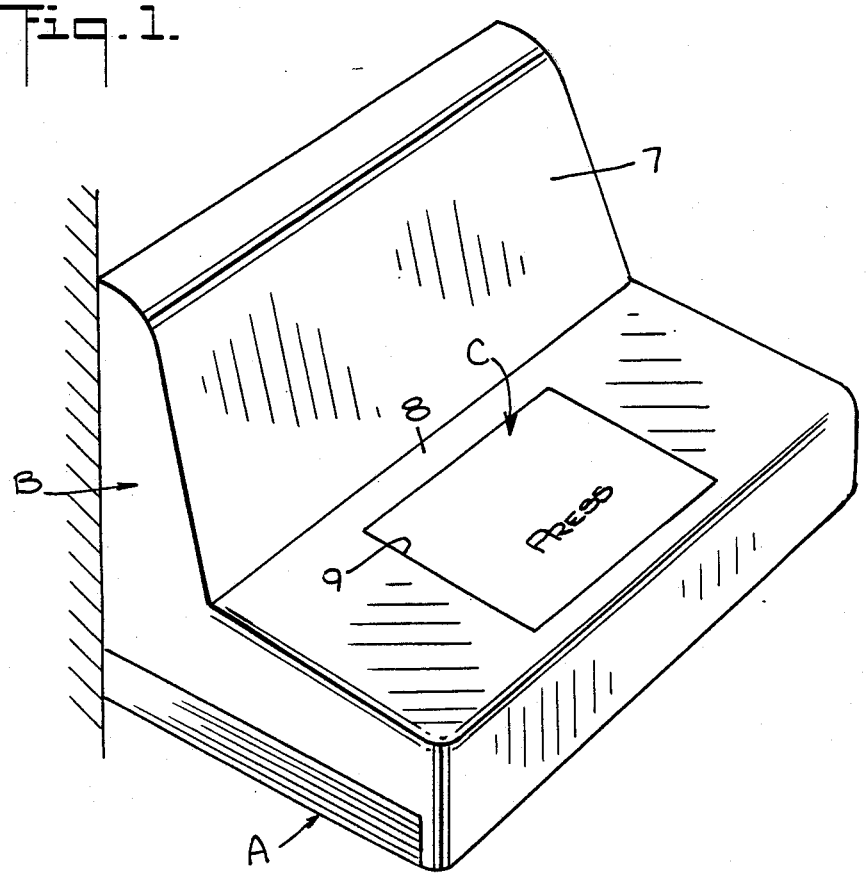
FIG. 1 is a perspective view showing the external appearance of the new fixture.
Figure 2:
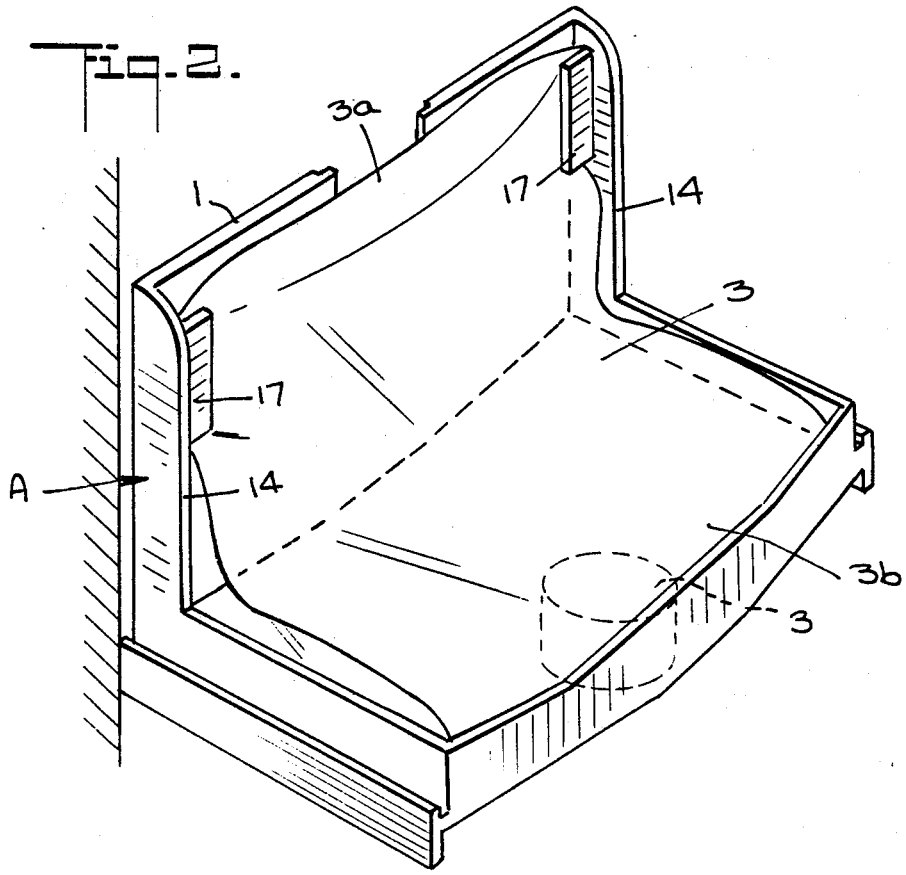
FIG. 2 is a partially transparent perspective view of the present invention with its cover removed.
Figure 3:
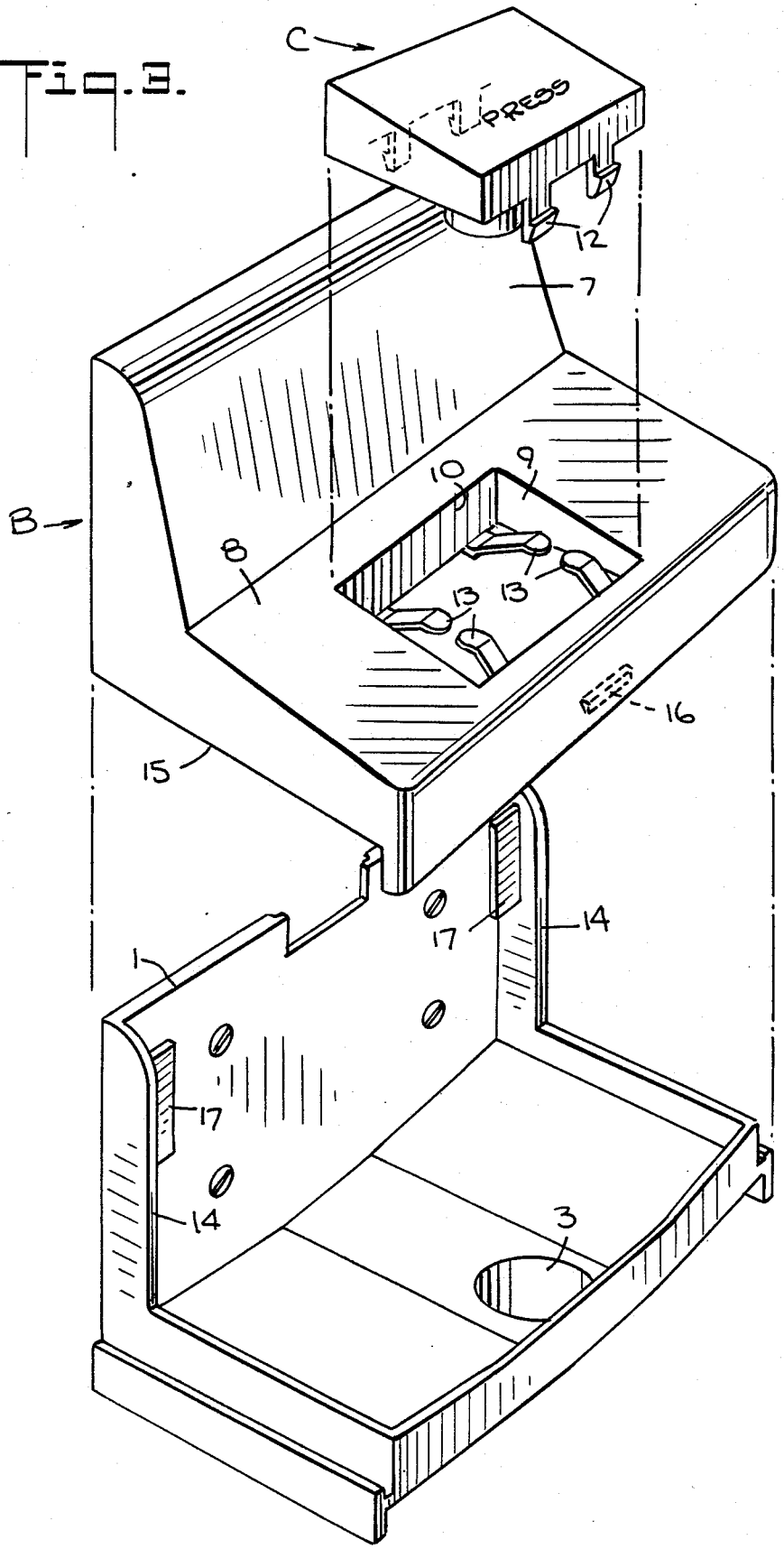
FIG. 3 is an exploded perspective view of the present invention.
Figure 4:
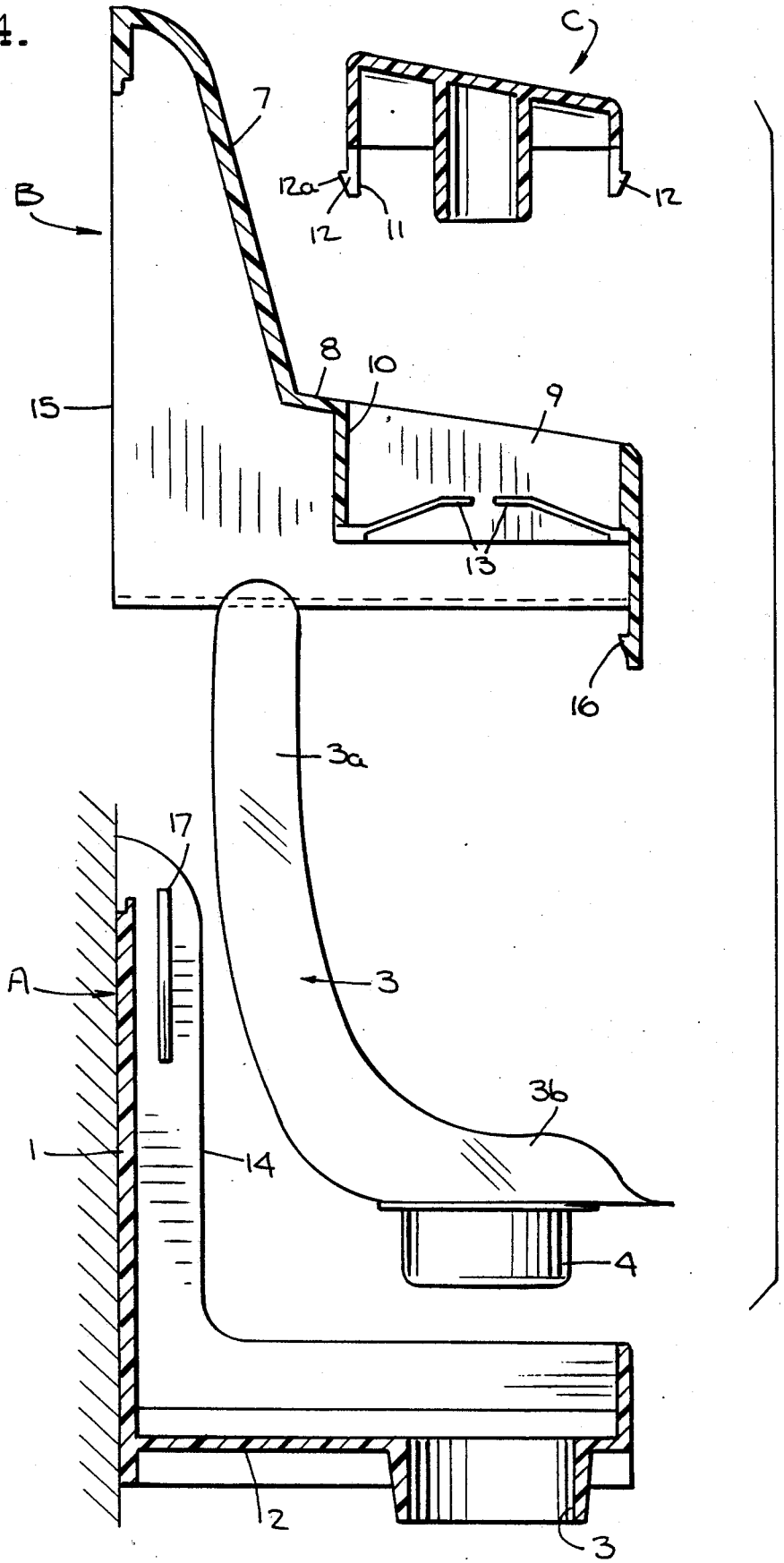
FIG. 4 is an exploded side cross-section of the present invention.
Figure 5:
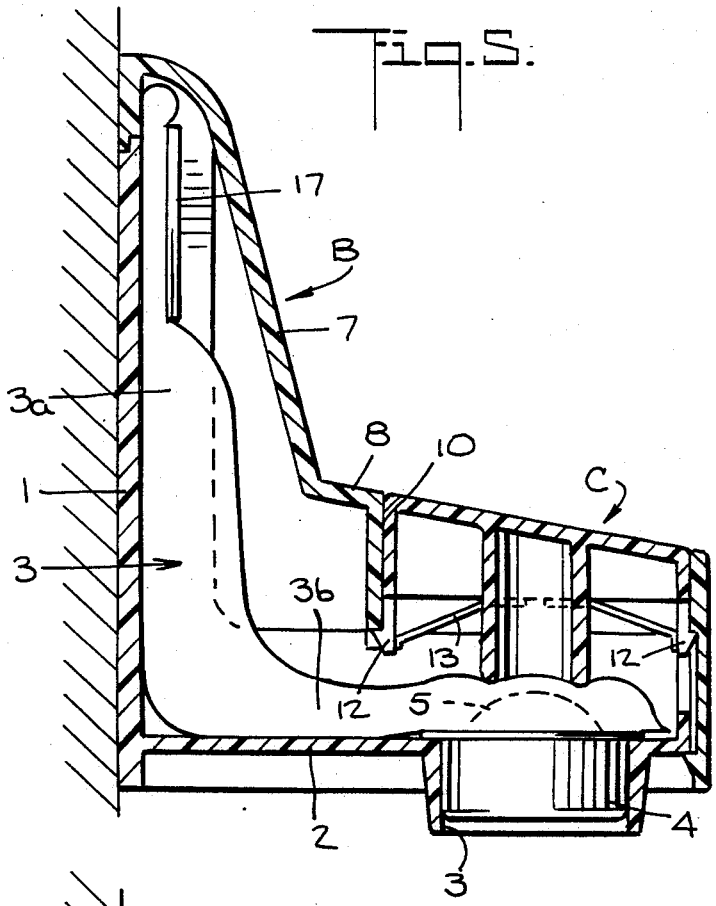
FIG. 5 is a side cross-section of the present invention ready for use.
Figure 6:
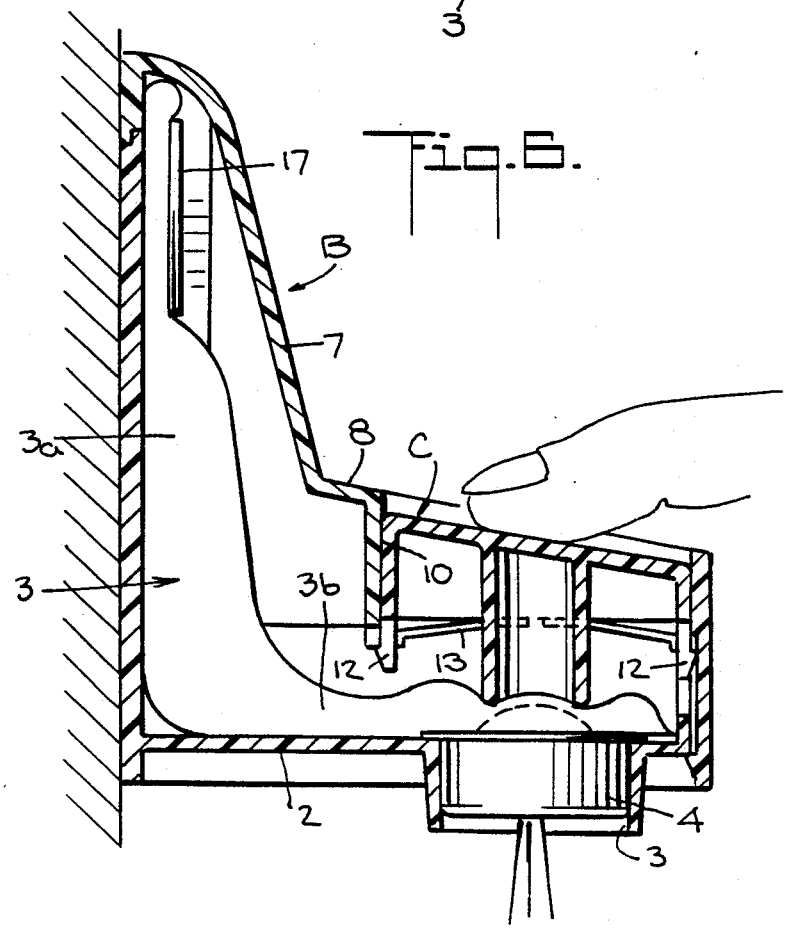
FIG. 6 is a side cross-section of the present invention in use.

These drawings show the new fixture with a bracket A, a cover B, and a push button C. The external appearance is somewhat like that of the patented fixture, but without the cover having the indent and window of that fixture. Also, the front of the push-button is enclosed by the cover.

The bracket A has an upstanding plate 1 from the bottom of which a shelf 2 having a nozzle hole 3 extends forwardly.

The liquid dispenser comprises a flexible bag 3 containing the liquid to be dispensed and having an upstanding main portion 3A upright in front of the plate 1 and a dispensing portion 3B folded forwardly horizontally on the shelf 2 and having a dispensing valve nozzle 4 extending downwardly through the nozzle hole 3. The valve has an upstanding operator 5 actuated by downward pressure. Each time the operator 5 is pressed downwardly a shot of the bag's content is discharged downwardly through the nozzle 4. Usually, the bag hermetically encloses a liquid soap. The bag and valve may be made in the prior art manner.

The cover B has an upstanding portion 7 covering the bag's upright main portion **3*a* and a forwardly extending portion 8 covering the bag's forwardly folded portion 3*b*. This portion 8 of the cover has an opening 9 above the valve's actuator 5**.

The push button C and the opening 9 are rectangular in cross section. The cover has a guideway 10 in the form of a short rectangular tube depending from the opening 9. The push button slidingly fits this guideway and has depending fingers 11 with bottom hooks 12 which engage the bottom edge of the guideway 10. The fingers 11 are elastically biased outwardly and the hooks 12 have angular surfaces **12*a* which wedge the fingers inwardly when the button is pushed downwardly into the guideway 10. At the bottom of the guideway the fingers spring outwardly and hook under the bottom of the guideway when the push button is pushed home in the guideway. The lower portion of the guideway has leaf springs 13 which bias the button upwardly with the hooked bottom ends of the spring fingers holding the button with its top flush with the top of the forwardly extending portion 8** of the cover.

The bracket A and cover B have interfitting edges 14 and 15 respectively forming a tongue and groove joint so that the cover can be slid down on the bracket with these parts locking together. The cover has a releasable latch 16 to hold the cover against upward removal.

The bracket A, the cover B and the push button C can each be made as an injection plastic molding in its entirety. This includes the springs, suitable plastics in thin cross section being elastic To assemble this new fixture the cover is slid down on the bracket with the tongue and groove edges engaging together and with the latch 16 of the cover snapping under the forwardly extending shelf of the bracket. The push button is pushed down in the guideway 9 with the angular surfaces of the bottom hooks of the fingers 11 wedging the fingers inwardly. The fingers normally are biased against the walls of the guideway 9. As the button is pushed downwardly its bottom deflects springs 13 until the bottom hooks of the fingers snap under the bottom edge of the guideway. The springs 13 then push the button upwardly to the limits set by the bottom hooks of the fingers. The parts are proportioned so at this time the top of the button is flush with the top of the forwardly extending portion of the cover B.

The back wall of the bracket A has flanges 17 behind which the upstanding portion of the bag can be tucked to hold this portion upright. The forwardly folded dispensing portion of this bag is positioned with its nozzle extended downwardly through the nozzle hole 9 in the brackets shelf. This is done while the cover B is removed from the bracket the cover subsequently being positioned on the bracket.

What is claimed is:

1. A wall fixture containing a liquid dispenser, the fixture comprising a bracket having an upstanding plate from the bottom of which a shelf having a nozzle hole extends forwardly and a removable cover in front of the plate and shelf, the dispenser comprising a flexible bag having front and back walls and containing the liquid and having an upstanding main portion upright in front of the plate and a dispensing portion folded forwardly on the shelf and having a dispensing valve having a dispensing nozzle extending downwardly through said nozzle hole, the valve having an upstanding operator actuated by downward pressure, the cover having a forwardly extending portion covering the bag's forwardly folded dispensing portion and an opening formed in this forwardly extending portion above said actuator, and a push button in said opening for applying downward pressure on said actuator; wherein the improvement comprises the cover having a guideway extending downwardly from said opening and in which the push button moves up and down on said actuator, the cover having springs biasing the push button upwardly and the push button having depending fingers with bottom hooks engaging the bottom of said guideway and holding the push button against the bias of said springs in which said guideway is formed by a short tube having a cross section slidingly fitted by the button and said fingers, the fingers being elastically biased outwardly and their bottom hooks having angular surfaces which wedge the fingers inwardly when the button is pushed downwardly into the guideway with the bottom hooks of the fingers hooking on the bottom of the guideway and holding the button against the upward bias of said springs.

2. The wall fixture of claim 1 in which the button and guideway have rectangular cross sections.

3. The wall fixture of claim 2 in which the cover's upstanding plate has flanges behind which the main portion of said bag is retained upright.

4. The wall fixture of claim 3 in which said bracket and cover have interfitting tongue and groove edges so that the cover can be slid on the bracket and held against lateral removal from the bracket.

5. The wall fixture of claim 4 having means for releasably holding the cover from upward removal from the bracket.

6. The wall fixture of claim 5 in which the bracket, cover and button are each an integral plastic injection molding.

* * * * *